US008353139B2

(12) United States Patent
Pilz et al.

(10) Patent No.: US 8,353,139 B2
(45) Date of Patent: Jan. 15, 2013

(54) WALL GAP FIRE BLOCK DEVICE, SYSTEM AND METHOD

(75) Inventors: Don A. Pilz, Livermore, CA (US); Raymond E. Poliquin, City of Industry, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 12/887,400

(22) Filed: Sep. 21, 2010

(65) Prior Publication Data

US 2011/0113709 A1 May 19, 2011

Related U.S. Application Data

(60) Provisional application No. 61/244,277, filed on Sep. 21, 2009.

(51) Int. Cl.
*E04C 2/00* (2006.01)

(52) U.S. Cl. ..... 52/232; 52/302.1

(58) Field of Classification Search ..... 52/46, 232.1, 52/241, 481.1, 481.2, 741.3, 846, 302.1, 52/302.3, 302.5, 95, 198, 199; 454/258, 454/254

See application file for complete search history.

(56) References Cited

U.S. PATENT DOCUMENTS

| | | | | | |
|---|---|---|---|---|---|
| 4,283,892 | A * | 8/1981 | Brown | 52/213 |
| 5,010,702 | A * | 4/1991 | Daw et al. | 52/241 |
| 5,127,203 | A * | 7/1992 | Paquette | 52/241 |
| 5,755,066 | A * | 5/1998 | Becker | 52/241 |
| 5,787,651 | A * | 8/1998 | Horn et al. | 52/144 |
| 5,913,788 | A * | 6/1999 | Herren | 52/241 |
| 5,921,041 | A * | 7/1999 | Egri, II | 52/241 |
| 5,950,385 | A * | 9/1999 | Herren | 52/481.1 |
| 6,176,053 | B1 * | 1/2001 | St. Germain | 52/232 |
| 6,783,345 | B2 * | 8/2004 | Morgan et al. | 425/110 |
| 7,152,385 | B2 * | 12/2006 | Morgan et al. | 52/745.05 |
| 7,240,905 | B1 * | 7/2007 | Stahl, Sr. | 277/652 |
| 7,617,643 | B2 * | 11/2009 | Pilz et al. | 52/232 |
| 7,681,365 | B2 * | 3/2010 | Klein | 52/232 |
| 7,752,817 | B2 * | 7/2010 | Pilz et al. | 52/207 |
| 7,950,198 | B2 * | 5/2011 | Pilz et al. | 52/232 |
| 2003/0089062 | A1 * | 5/2003 | Morgan et al. | 52/317 |
| 2003/0213211 | A1 * | 11/2003 | Morgan et al. | 52/745.05 |
| 2004/0045234 | A1 * | 3/2004 | Morgan et al. | 52/232 |
| 2006/0137293 | A1 * | 6/2006 | Klein | 52/782.1 |
| 2009/0038764 | A1 * | 2/2009 | Pilz | 160/194 |
| 2009/0049777 | A1 * | 2/2009 | Pilz et al. | 52/302.1 |
| 2009/0090074 | A1 * | 4/2009 | Klein | 52/232 |
| 2009/0094912 | A1 * | 4/2009 | Klein | 52/232 |

(Continued)

*Primary Examiner* — Mark Wendell

(74) *Attorney, Agent, or Firm* — Knobbe, Martens, Olson & Bear, LLP

(57) ABSTRACT

Fire block devices for application to a wall component. The fire block device can be a strip that includes a fire-resistant material strip comprised of a material that expands in response to sufficient heat to create a fire-resistant barrier. An optional foam strip comprised of a foam material can be placed side-by-side with the fire-resistant material strip. A cover layer covers the fire-resistant material strip and the optional foam strip, if present. The cover layer includes opposing side portions positioned on opposing sides of the fire-resistant material strip and foam strip, if present. The cover layer is comprised of a tape having an adhesive on an underneath surface thereof such that adhesive on the side portions are capable of securing the fire block strip to a wall component. The fire block strip can be applied to a header track, footer track or wall stud, among other possible components.

20 Claims, 4 Drawing Sheets

U.S. PATENT DOCUMENTS

2009/0178363 A1* 7/2009 Pilz et al. ..... 52/710
2010/0126092 A1* 5/2010 Pilz et al. ..... 52/232
2011/0185656 A1* 8/2011 Klein ..... 52/232
2011/0214371 A1* 9/2011 Klein ..... 52/232

* cited by examiner

WALL GAP FIRE BLOCK DEVICE, SYSTEM AND METHOD

RELATED APPLICATIONS

This application claims the benefit under 35 U.S.C. §119 (e) to U.S. Provisional Patent Application No. 61/244,277, filed Sep. 21, 2009, which is incorporated in its entirety by reference herein.

BACKGROUND OF THE INVENTION

1. Field of the Invention

The present invention relates to fire-resistant arrangements for building structures. In particular, disclosed arrangements are wall gap fire resistant structures or "fire blocks" that reduce or prevent fire, air, smoke and heat from passing from one side of a wall to the other side through a wall gap.

2. Description of the Related Art

Conventional head-of-wall fire blocks are typically labor-intensive to install. As a result, most conventional fire blocks are expensive. One example of a conventional fire block arrangement involves a fire resistant material, such as mineral wool, stuffed into gaps at the head-of-wall. Once the gaps are filled with the fire block material, a flexible coating, such as a spray-on elastomeric coating, covers the entire head-of-wall to secure the fire block material in place. As noted, such an arrangement requires a significant amount of time to install. In addition, over a period of time, the flexible coating may degrade, resulting in cracks and/or flaking. As a result, it is possible that the fire resistant material may become dislodged from the head-of-wall gaps thereby reducing the effectiveness of the fire block.

The assignee of the present application has developed more advanced head-of-wall fire block arrangements, sold under the trademark FAS TRACK®. The FAS TRACK® fire block header track utilizes an expandable fire-resistant material, such as an intumescent material, applied along a length of the header track of a wall assembly. The intumescent material wraps around a corner of the header track, extending both along a portion of a web of the header track and a flange of the header track. The intumescent advantageously is held in place between the web of the header track and the floor or ceiling above the wall. When exposed to a sufficient temperature, the intumescent material expands to fill gaps at the head-of-wall. The portion of the intumescent trapped between the header track and the floor or ceiling ensures that the intumescent stays in place as it expands and does not become dislodged as a result of the expansion. U.S. patent application Ser. Nos. 12/013,361; 12/196,115; 12/040,658; 12/039,685; and 12/325,943, assigned to the Assignee of the present application, describe construction products incorporating intumescent materials and are incorporated by reference herein in their entireties.

SUMMARY OF THE INVENTION

Although the FAS TRACK® fire block header track provides exceptional performance, there still exists a need for fire block arrangements that can be applied to any desired structure, such as the top of a wood stud wall assembly or to header tracks that are not FAS TRACK® fire block header tracks. Furthermore, as described herein, preferred embodiments of the wall gap fire blocks can be applied to a wall bottom track to protect a foot-of-wall gap or a (vertical or horizontal) gap in a location other than the head or foot of a wall. In addition, the intumescent material in a FAS TRACK® fire block header track preferably is applied at the factory during the manufacturing process. In some circumstances, it may be desirable to apply the intumescent material on site. Thus, certain preferred embodiments of the present fire blocks are well-suited to application on the job site.

Preferred embodiments of the present invention provide an adhesive fire resistant material strip that can be applied to a header track or other head-of-wall structure to create a head-of-wall fire block. The adhesive fire block strip may include an intumescent strip portion, among other material portions, if desired. In one arrangement, a foam strip portion is positioned adjacent to the intumescent strip portion and a clear poly tape layer covers both the intumescent strip portion and the foam strip portion. Preferably, the poly tape layer is wider than the combined width of the intumescent strip portion and the foam strip portion such that side portions of the poly tape layer can include an adhesive and be used to secure the fire block strip to a header track or other head-of-wall structure. The underneath surface of the intumescent strip portion and the foam strip portion may also include an adhesive, if desired. Preferably, a removable protective layer covers the underneath surface of the entire fire block strip until the fire block strip is ready to be applied.

The fire block strip can be applied to a header track or other construction product, such as a bottom track, metal stud, metal flat strap or any other framing member that needs an open gap between the wallboard and a perimeter structure for movement (deflection or drift). The fire block strip allows the gap to stay open for movement and provides fire and smoke protection and sound reduction. Preferably, the fire block strip is applied such that it wraps the upper corner of the header track or other head-of-wall structure. The foam strip portion may be positioned on the top of the header track or other head-of-wall structure to provide a smoke, air and sound seal at the head-of-wall. The intumescent strip portion may be positioned on a side flange of the header track or side surface of the other head-of-wall structure such that the intumescent strip, portion is positioned between the header track or other head-of-wall structure and the wall board. The poly tape layer secures the foam strip portion and the intumescent strip portion to the header track or other head-of-wall structure and provides protection in the event that the wall is designed to accommodate vertical movement, which could result in the wall board rubbing against the fire block strip. However, the poly tape layer still permits the intumescent strip portion to expand when exposed to a sufficient temperature.

A preferred embodiment involves a fire block wall component including a metal track having a web and a pair of legs extending in the same direction from opposite sides of the web. A fire block strip is applied lengthwise along the metal track. The fire block strip includes a fire-resistant material strip comprised of a material that expands in response to sufficient heat to create a fire-resistant barrier and a cover layer that covers the fire-resistant material strip and includes opposing side portions positioned on opposing sides of the fire-resistant material strip. The cover layer is comprised of a tape having an adhesive on an underneath surface thereof such that adhesive on the side portions secure the fire block strip to the metal track.

Another preferred embodiment involves a fire block strip for application to a wall component, including a fire-resistant material strip, a foam strip and a cover layer. The fire-resistant material strip is comprised of a material that expands in response to sufficient heat to create a fire-resistant barrier. The foam strip is comprised of a foam material and placed side-by-side with the fire-resistant material strip. A cover layer covers the fire-resistant material strip and the foam strip. The cover layer includes opposing side portions positioned on opposing sides of the fire-resistant material strip and foam strip. The cover layer is comprised of a tape having an adhesive on an underneath surface thereof such that adhesive on the side portions are capable of securing the fire block strip to a wall component.

Yet another preferred embodiment involves a fire block wall structure, including a wall frame comprising a plurality of studs and a wood header or footer, wherein an upper or lower end of each of the studs is connected to the wood header or footer, respectively. A fire block strip is applied lengthwise along the wood header or footer. The fire block strip includes a fire-resistant material strip and a cover layer. The fire-resistant material strip is comprised of a material that expands in response to sufficient heat to create a fire-resistant barrier. The cover layer covers the fire-resistant material strip and includes opposing side portions positioned on opposing sides of the fire-resistant material strip. The cover layer is comprised of a tape having an adhesive on an underneath surface thereof such that adhesive on the side portions secure the fire block strip to the wood header or footer. A wallboard member is attached to the studs and contacts the fire block strip.

Other preferred embodiments involve methods of manufacturing the fire block strip and/or a header, footer or stud with a fire block strip. Preferred embodiments also involve methods of assembling a wall including a header, footer or stud incorporating a fire block strip.

BRIEF DESCRIPTION OF THE DRAWINGS

The above-described and other features, aspects and advantages of the present invention are described below with reference to drawings of preferred embodiments, which are intended to illustrate, but not to limit, the invention. The drawings contain eight figures.

DETAILED DESCRIPTION OF THE PREFERRED EMBODIMENTS

Figure 1A:
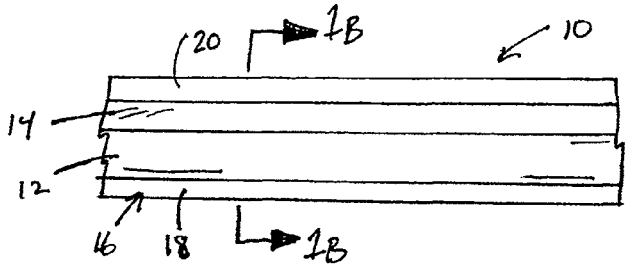
FIG. 1A is a top view of a portion of a fire block strip assembly having certain features, aspects and advantages of the present invention.
Figure 1B:
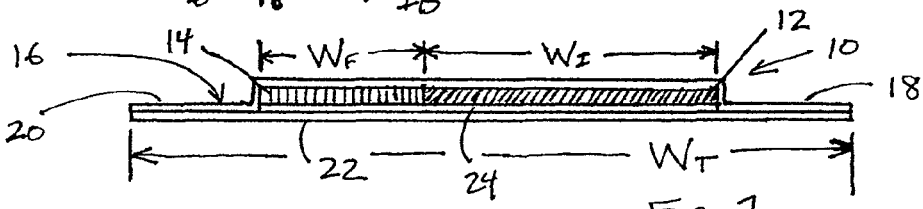
FIG. 1B is a cross-sectional view of the fire block strip assembly of FIG. 1A. The cross-section view of FIG. 1B is taken along line 1B-1B of FIG. 1A.

FIGS. 1*a* and 1*b* illustrate a fire block strip assembly 10, which is also referred to herein as a fire block strip or, simply, a strip. The fire block strip 10 is an elongate strip assembly that preferably is constructed as an integrated assembly of multiple components. The fire block strip 10 may be supplied on a roll, in a folded arrangement or any other suitable manner. Preferably, the fire block strip 10 is provided as a separate component that is applied to a head-of-wall in the field, as is described in greater detail below. Alternatively, the fire block strip 10 may be pre-assembled to a header track during manufacture.

The illustrated fire block strip 10 includes a fire-resistant material strip portion 12 ("fire-resistant material strip 12") and a foam strip portion 14 ("foam strip 14"). The fire-resistant material strip 12 and the foam strip 14 are positioned side-by-side and co-planar with one another. A cover layer 16 covers both the fire-resistant material strip 12 and the foam strip 14. Preferably, the cover layer 16 also includes side portions 18 and 20 that extend outwardly from the fire-resistant material strip 12 and the foam strip 14, respectively. Alternatively, the cover layer 16 may cover only the fire-resistant material strip 12 and foam strip 14 and the side portions 18 and 20 may be omitted. In such an arrangement, the strip 10 may be secured to a construction product by an adhesive applied to the bottom of the fire-resistant material strip 12 and the foam strip 14.

The fire-resistant material strip 12 may be constructed partially or entirely from an intumescent material, such as BlazeSeal™ from Rectorseal of Houston, Tex. Other suitable intumescent materials are available from Hilti Corporation, Specified Technologies, Inc., or Grace Construction Products. The intumescent material expands to many times its original size when exposed to sufficient heat. Thus, intumescent materials are used as a fire block because the expanding material tends to fill gaps. Once expanded, the intumescent material is resistant to smoke, heat and fire and inhibits fire from passing through the head-of-wall. The fire-resistant material strip 12 may be referred to as an intumescent strip 12 herein. It is understood that the term intumescent strip 12 is used for convenience and that the term is to be interpreted to cover other expandable fire-resistant materials as well, unless otherwise indicated.

The foam strip 14 is preferably made from a suitable foam or foam-like material that is an open or closed cell structure and is compressible. Suitable materials may include polyester and polyether, among others. The foam strip 14 preferably forms a seal between the top of the wall on which the fire block strip 10 is applied and the floor or ceiling (or other horizontal support structure) above the wall.

Preferably, a removable protective layer 22 covers the underneath surface of the fire block strip 10. An optional adhesive layer 24 may be included underneath the intumescent strip 12 and the foam strip 14 and covered by the protective layer 22. In addition, preferably, the cover layer 16 includes an adhesive layer (not shown) on the underneath side that faces the intumescent strip 12, foam strip 14 and protective layer 22. Thus, in some arrangements, the cover layer 16 is a tape, such as a polypropylene tape, also referred to herein as poly tape. Other suitable tapes may also be used. The cover layer 16 may be clear or somewhat clear such that the intumescent strip 12 and foam strip 14 are visible through the cover layer 16 to ease assembly onto a header track or other head-of-wall structure. In addition or in the alternative, a marking (such as a mark line) may be provided on the outer (upper) surface of the cover layer 16 to indicate the location of the junction between the intumescent strip 12 and foam strip 14. The marking or junction can be used to locate the intumescent strip 12 and foam strip 14 relative to the structure on which it is placed, such as the corner of a top or bottom track, for example.

The fire block strip 10 has an overall width $W_T$ from an outside edge of the side portion 18 to an outside edge of the side portion 20. The width $W_T$ may vary depending on the desired application and/or desired deflection requirement of the fire block strip 10. Preferably, the width $W_T$ is between about three (3) inches and about six (6) inches. In one arrangement, the width $W_T$ is about four (4) inches. The intumescent strip has a width $W_I$ and the foam strip has a width $W_F$. The combined width of the intumescent strip width $W_I$ and the foam strip width $W_F$ is less than the total width $W_T$ by an amount that provides a sufficient width to each of the side portions 18, 20 such that the side portions 18, 20 are capable of securely affixing the fire block strip 10 to a desired structure, such as a header track or other wall structure. In some arrangements, the width $W_I$ of the intumescent strip 12 may be greater than the width $W_F$ of the foam strip 14. For example, the width $W_I$ of the intumescent strip 12 may be about one and one-half to about two times the width $W_F$ of the foam strip 14. However, in other arrangements, the intumescent strip 12 may be about the same width as the foam strip 14, or the foam strip 14 may be wider than the intumescent strip 12. The width $W_I$ of the intumescent strip 12 may be determined by the size of any head-of-wall gap (or other wall gap) to be filled and/or by the degree of vertical (or other) movement permitted by the wall structure. The width $W_F$ of the foam strip 14 may be determined by the width of the wall structure and/or by the amount of sealing desired.

Figure 2:
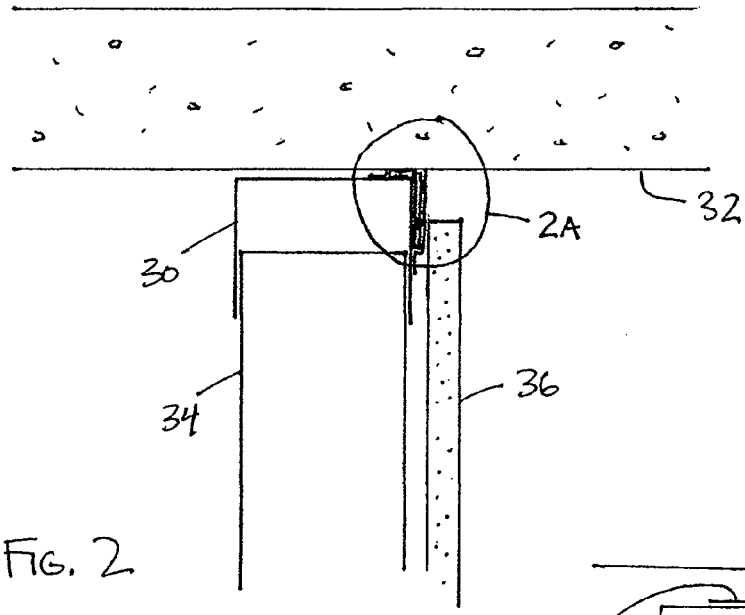
FIG. 2 is a view of a stud wall assembly with the fire block strip assembly of FIG. 1A installed at the head-of-wall.
Figure 2A:
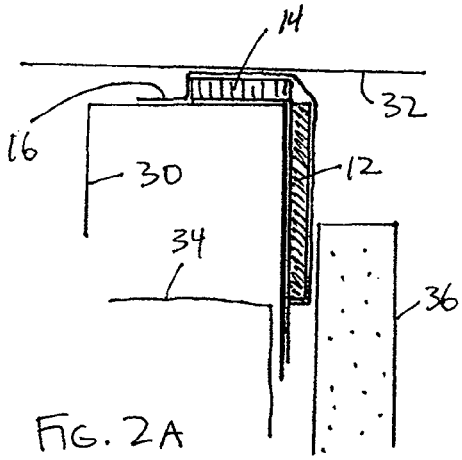
FIG. 2A is a view of a portion of the wall assembly of FIG. 2 identified by the circle 2A in FIG. 2.

FIGS. 2 and 2*a* illustrate the fire block strip 10 applied to a head-of-wall structure, in particular to a header track 30. The header track 30 is a U-shaped channel that is attached to an upper horizontal support structure 32, such as a floor of an upper floor or a ceiling. Wall studs 34 are received in the header track 30 and may be configured for vertical movement relative to the header track 30, as is known in the art. A wall board 36 is attached to the studs 34, such as by a plurality of suitable fasteners. Although not shown, a footer track receives the lower end of the studs 34, as is known in the art. The fire block strip 10 is attached to the header track 30 such that a portion of the fire block strip 10 is positioned between the header track 30 and the horizontal support structure 32 and another portion of the fire block strip 10 is positioned between the header track 30 and the wall board 36.

With reference to FIG. 2*a*, preferably, the foam strip 14 is positioned between the header track 30 and the horizontal support structure 32 and the intumescent strip 12 is positioned on the flange portion of the header track 30 between the header track 30 and the wall board 36. Preferably, the transition or junction between the intumescent strip 12 and the foam strip 14 is aligned with the corner between the web and flange portions of the header track 30. The cover layer 16 secures the fire block strip 10 to the header track 30. In addition, if an adhesive layer 24 is provided, the adhesive layer 24 may assist in securing the fire block strip 10 to the header track 30. Although a fire block strip 10 is shown on only one side of the header track 30, a second fire block strip 10 may be positioned on the opposite side of the header track 30.

When exposed to a sufficient temperature, the intumescent strip 12 will expand to fill gaps between the header track 30 and the horizontal support structure 32. The cover layer 16 may degrade in response to the exposure to an elevated temperature or in response to pressure exerted by the expansion of the intumescent strip 12, but in any event preferably will assist in maintaining the intumescent strip 12 in place until the expansion of the intumescent strip 12 is sufficient to hold the intumescent strip 12 in place. In addition, or in the alternative, the adhesive layer 24 may assist in keeping the intumescent strip 12 in place.

Figure 3:
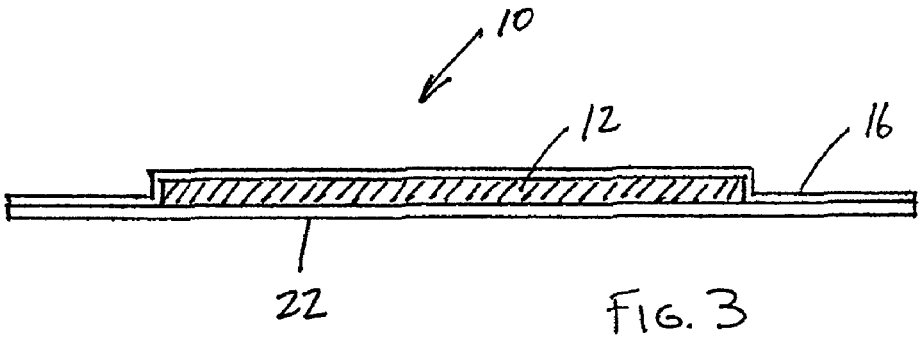
FIG. 3 is a cross-sectional view of another fire block strip assembly.
Figure 4:
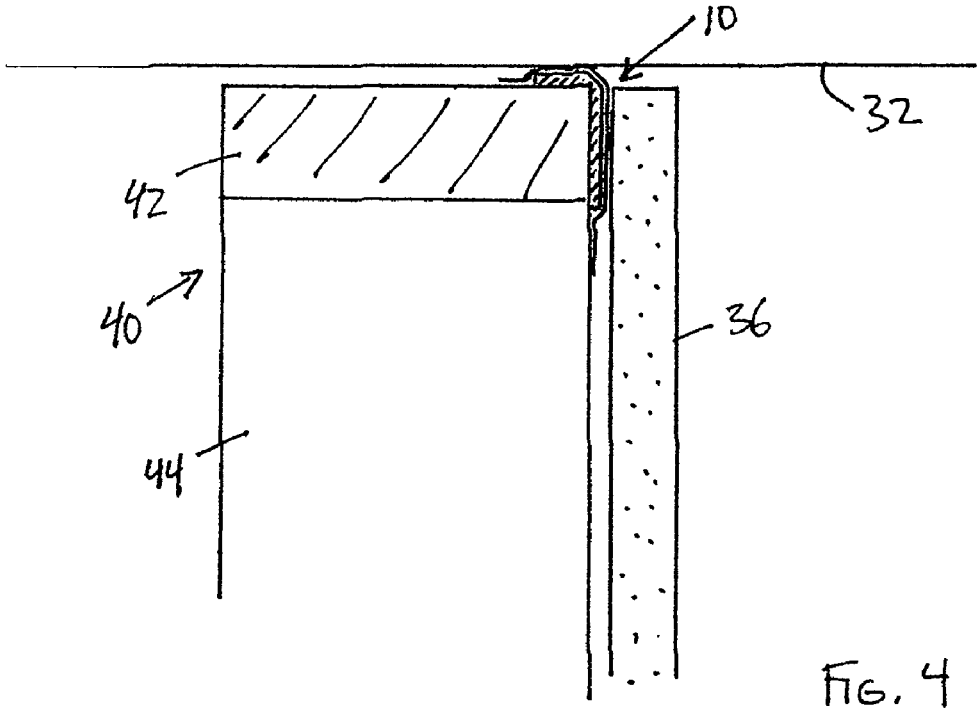
FIG. 4 is a view of a portion of a wood stud wall assembly with the fire block strip assembly of FIG. 3 installed at the head-of-wall.

FIGS. 3 and 4 illustrate another embodiment of a fire block strip 10, which is similar to the fire block strip 10 of FIGS. 1 and 2. Accordingly, the same reference numbers are used to indicate the same or similar components or features between the two embodiments. The fire block strip 10 of FIGS. 3 and 4 includes an intumescent strip 12, but omits the foam strip. A cover layer 16 covers the intumescent strip 12 and also extends to each side. An adhesive layer (not shown) may be located on the underneath surface of the intumescent strip 12, similar to the adhesive layer 24 of the fire block strip 10 of FIGS. 1 and 2. In addition, the cover layer 16 may include an adhesive layer (not shown) as described above in connection with the embodiment of FIGS. 1 and 2. A removable protective layer 22 covers the underneath surface of the intumescent layer 12 and the side portions of the cover layer 16.

FIG. 4 illustrates the fire block strip 10 applied to a head-of-wall structure, in particular a wood stud wall 40 including a header 42 and a plurality of studs 44. The fire block strip 10 is applied in a manner similar to the fire block strip 10 of FIGS. 1 and 2 with a portion of the fire block strip 10 between the header 42 and the horizontal support structure 32 and a portion between the header 42, and possibly the studs 44, and the wall board 36. The intumescent strip 12 wraps the corner of the header 42. As discussed above, the fire block strip 10 may include a marking to assist in the proper positioning on the corner of the header 42, such as a linear marking, for example. In addition or in the alternative, the intumescent strip 12 may be divided into two portions such that one portion can be positioned on top of the header 42 and the other portion can be positioned on the side of the header 42.

Figure 5:
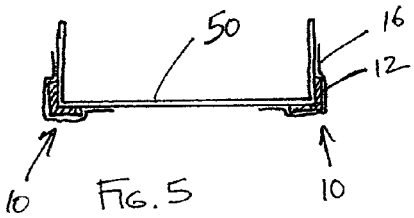
FIG. 5 is cross-sectional view of a fire block strip assembly applied to a bottom track.
Figure 6:
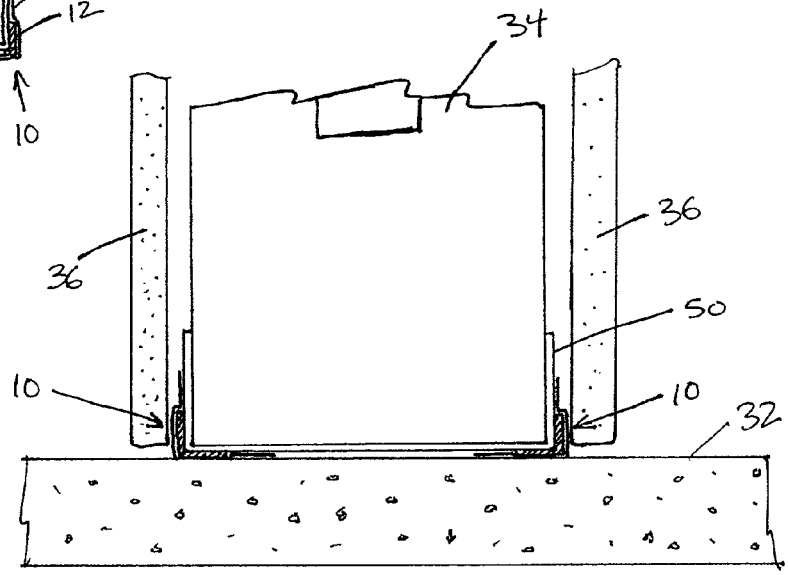
FIG. 6 is a cross-sectional view of the bottom track of FIG. 5 installed at a foot-of-wall.

FIGS. 5 and 6 illustrate another application of a fire block strip 10, which is similar to the fire block strips 10 of FIGS. 1-4, applied to corners of a bottom track 50. With reference to FIG. 5, the fire block strip 10 includes an intumescent strip 12, but omits the foam strip. However, a foam strip could be included if desired and preferably would be positioned underneath the bottom track 50. Similar to the prior embodiments, a cover layer 16 covers the intumescent strip 12 and also extends to each side. An adhesive layer (not shown) may be located on the underneath surface of the intumescent strip 12, similar to the adhesive layer 24 of the fire block strip 10 of FIGS. 1 and 2. In addition, the cover layer 16 may include an adhesive layer (not shown) as described above in connection with the embodiment of FIGS. 1 and 2. A removable protective layer may be provided to cover the underneath surface of the intumescent layer 12 and the side portions of the cover layer 16. In the illustrated arrangement, a fire block strip 10 is applied at each corner of the bottom track 50.

With reference to FIG. 6, the bottom track 50 is illustrated as a component in a wall assembly. The wall assembly rests on a horizontal support structure 32, such as a concrete floor. A plurality of studs 34 (one shown) are received within the bottom track 50 and preferably are secured to the bottom track with suitable fasteners (not shown). Wallboards 36 are attached on opposing sides of the studs 34, such as by a plurality of suitable fasteners (not shown). In an embodiment that includes a foam strip, preferably, the foam strip is located between the bottom track 50 and the floor 32. In the event of a fire, the fire block strips 10 expand to seal the gap between the wallboard 36 and floor 32 and between the bottom track 50 and floor 32.

Figure 8:
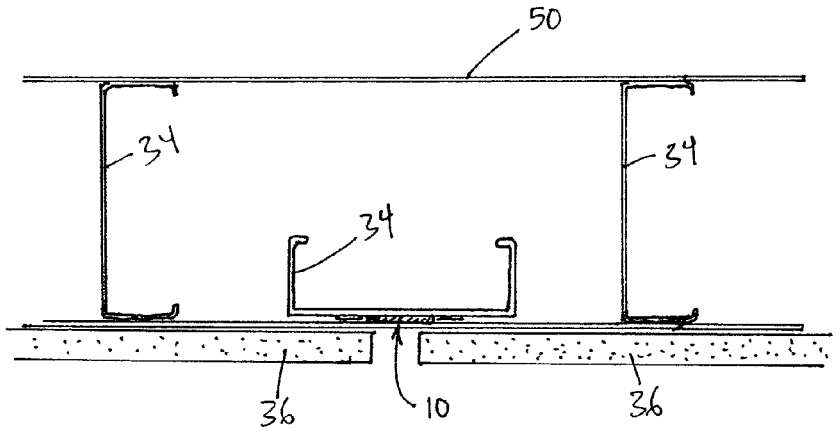
FIG. 8 is a cross-sectional view of the stud of FIG. 7 installed in a wall assembly at a vertical wall gap.
Figure 7:
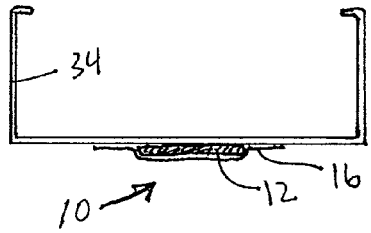
FIG. 7 is a cross-sectional view of a fire block strip assembly applied to a stud.

FIGS. 7 and 8 illustrate yet another application of the fire block strip 10, in which the strip 10 is applied to a wall stud 34. The strip 10, itself, may be similar to the strip 10 of FIGS. 1 and 2 (including a foam strip 14) or it may be similar to the strip 10 of FIGS. 3 and 4 (omitting the foam strip 14). The strip 10 is applied to a wall stud 34 to provide a fire block at a gap that is not at the head-of-wall or foot-of-wall. In the illustrated arrangement, the strip 10 is applied to an outer surface of the web of the C-shaped wall stud 34. Preferably, the strip 10 is applied lengthwise along a center portion of the web of the wall stud 34. However, in other arrangements, the strip 10 can be applied to other portions of the stud 34 so that the strip 10 generally aligns with a gap present between pieces of wallboard 36. For example, the strip 10 could be placed on the corner of the stud 34 or on a side wall of the stud 34.

With reference to FIG. 8, the wall stud 34 with the fire block strip 10 applied thereto is assembled into a wall assembly. As is known in the art, a plurality of studs 34 extend in a vertical direction from a bottom track 50. The studs 34 support pieces of wallboard 36. The stud 34 with the fire block strip 10 is positioned at a gap between wallboard 36 pieces, with the outer surface of the web facing the wallboard 36 and positioned adjacent to the wallboard 36. The stud 34 with the fire block strip 10 may be secured to the bottom track 50 and header track (not shown) by suitable fasteners, such as screws. In the event of a fire, the fire block strip 10 expands to seal the gap between the pieces of wallboard 36.

Figure 9:
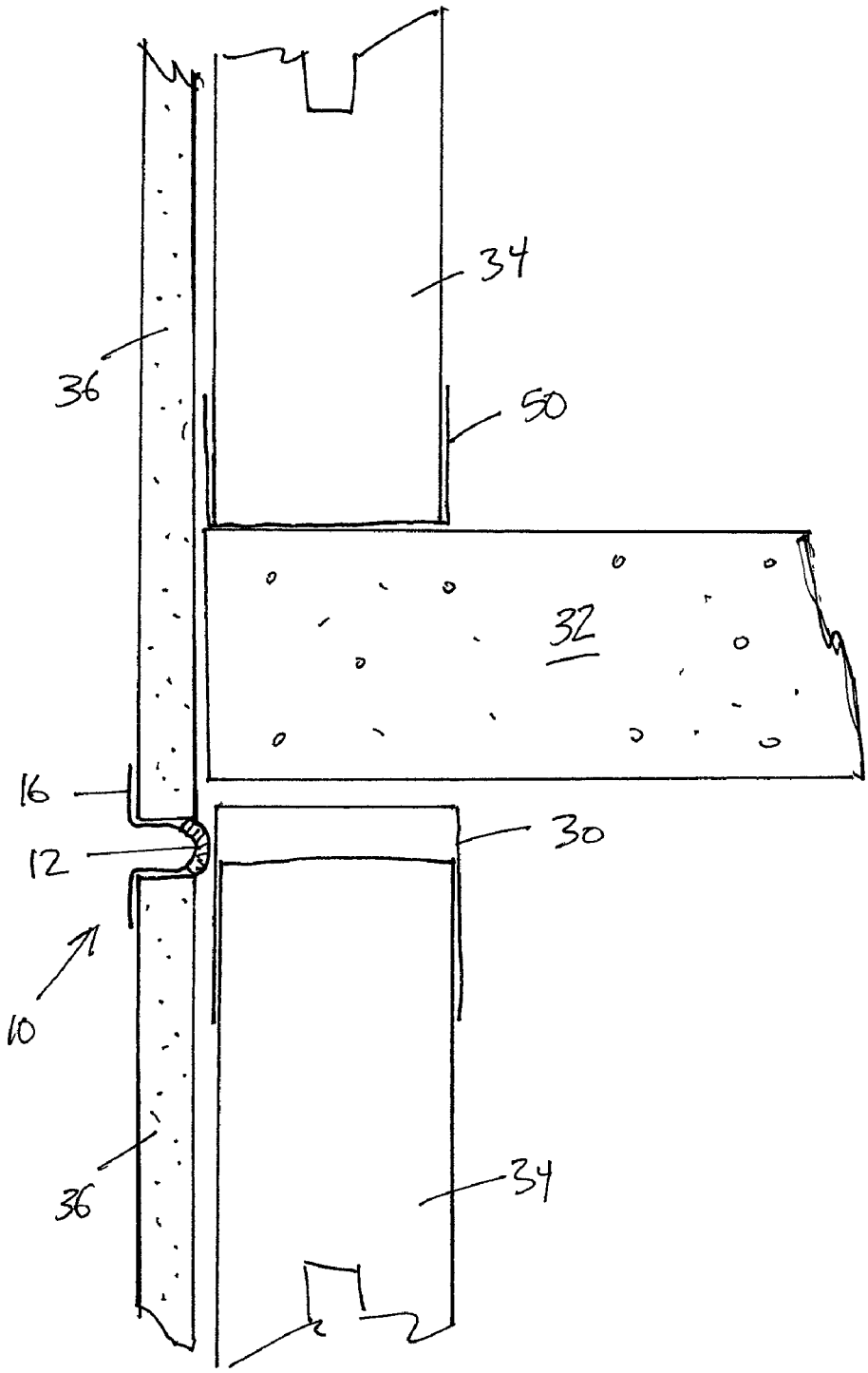
FIG. 9 is a cross-sectional view of an interior or exterior wall assembly with a deflection gap between the upper and lower wallboards or sheathing.

With reference to FIG. 9, another embodiment of a fire block strip 10 is illustrated protecting a gap in an interior or exterior wall assembly. The wall assembly includes a first (lower) wall portion, which includes a stud wall having a bottom track (not shown), a plurality of studs 34, a header track 30 and a wallboard member 36. The wall assembly also includes a second (upper) wall portion having a bottom track 50, a plurality of studs 34, a header track (not shown) and a wallboard member 36. The upper and lower wall portions are separated by a horizontal support structure, such as a floor 32. As noted, the wall assembly can be interior or exterior. In an interior wall assembly, the wallboard members 36 may be drywall. In an exterior wall assembly, the wallboard members 36 may be any type of suitable exterior sheathing element.

As illustrated, a horizontal deflection (or drift) gap exists between the upper and lower wallboard members 36 to accommodate relative vertical (or horizontal) movement between the wallboard members 36 (and upper and lower wall portions). The fire block strip 10 is positioned in the deflection gap to seal the gap in the event of a fire. The fire block strip 10 may be similar to any of the strips 10 described above and, preferably, includes at least and intumescent strip 12 and a cover layer 16. The width of the intumescent strip 12 preferably is substantially equal to or greater than the width of the deflection gap. The cover layer 16 preferably includes adhesive on it's underneath surface to permit the fire block strip 10 to be affixed to the wallboard members 36. The width of the cover layer 16 preferably is influenced by the thickness of the wallboard members 36. Preferably, the cover layer 16 is wide enough such that each side extends from the intumescent strip 12 along the edge of the wallboard member 36 facing the gap and onto the outer surface of the wallboard member 36 a sufficient distance to achieve an adhesive bond strong enough to secure the fire block strip 10 in place. Thus, preferably, the entire width of the fire block strip 10 is greater than the width of the deflection gap in its widest position plus the thickness of each of the wallboard members 36 defining the deflection gap. Preferably, the width of the fire block strip 10 is greater than this width by an amount suitable to permit secure adhesion of the outer edges of the strip 10 to the outer surfaces of the wallboard members 36, which may be determined by the type of adhesive employed. Furthermore, other suitable methods in addition or in the alternative to adhesives may be used, such as mechanical fasteners, for example.

The disclosed fire block strips 10 are well-suited for application in the field to a variety of different head-of-wall structures, including both metal header tracks and wood headers, among other possibilities. However, the fire block strip 10 may also be applied as a part of the manufacturing process, as the cover layer 16 provides protection for the intumescent strip 12 (and foam strip 14, if present) during transport and storage. In addition, the fire block strip 10 can be applied to a wall construction product in the locations and applications shown in U.S. patent application Ser. Nos. 12/013,361; 12/196,115; 12/040,658; 12/039,685; and 12/325,943, assigned to the Assignee of the present application, which are incorporated by reference herein in their entireties.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present fire block device, system and method has been described in the context of particularly preferred embodiments, the skilled artisan will appreciate, in view of the present disclosure, that certain advantages, features and aspects of the device, system and method may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A fire block wall component, comprising:

a metal track having a web and a pair of legs extending in the same direction from opposite sides of the web, the web and each of the pair of legs defining a corner of the metal track;

a fire block strip applied lengthwise along the metal track and extending only partially across the web of the metal track such that the fire block strip is positioned along no more than one of the corners of the metal track, the fire block strip, comprising:

a fire-resistant material strip comprised of a material that expands in response to sufficient heat to create a fire-resistant barrier;

a cover layer that covers the fire-resistant material strip and includes opposing side portions positioned on opposing sides of the fire-resistant material strip outwardly of opposing outermost side edges of the fire-resistant material strip such that no portion of the fire-resistant material strip is positioned between the side portion and the portion of the metal track to which the side portion is attached, wherein the cover layer is comprised of a tape having an adhesive on an underneath surface thereof such that adhesive on the side portions secure the fire block strip to the metal track.

2. The fire block wall component of claim 1, additionally comprising a foam strip comprised of a foam material and placed side-by-side with the fire-resistant material strip such that respective upper and lower surfaces of the foam strip and fire-resistant material strip are co-planar with one another when the fire block strip is in a planar orientation, wherein the cover layer covers the foam strip and side portions of the cover layer are positioned on opposing sides of the combination of the fire-resistant material strip and the foam strip.

3. The fire block wall component of claim 2, wherein the fire block strip is applied to a corner of the track between the web and one of the legs and a juncture between the fire-resistant material strip and the foam strip is aligned with the corner.

4. The fire block wall component of claim 3, wherein the foam strip is positioned only on the web and the fire-resistant material strip is positioned only on the leg.

5. The fire block wall component of claim 4, wherein the metal track is a header track.

6. The fire block wall component of claim 4, wherein the metal track is a footer track.

7. The fire block wall component of claim 1, wherein the metal track is a stud and the fire block strip is applied to an outer surface of the web, which faces away from the legs of the stud.

8. The fire block wall component of claim 7, wherein the fire block strip is positioned along only a central portion of the web and does not extend over either corner of the metal track.

9. The fire block wall component of claim 1 assembled in a wall structure, wherein the fire block strip is positioned at a gap between a wallboard panel and another component.

10. The fire block wall component of claim 9, wherein the other component is a floor, ceiling or another wallboard panel.

11. A fire block strip for application to a wall component, comprising:

a fire-resistant material strip comprised of a material that expands in response to sufficient heat to create a fire-resistant barrier;

a foam strip comprised of a foam material and placed side-by-side and co-planar with the fire-resistant material strip such that the foam strip and the fire-resistant material strip form a strip arrangement and upper and lower surfaces of the fire-resistant material strip and foam strip are co-planar with one another when the fire block strip is in a planar orientation;

a cover layer that covers the strip arrangement, wherein the cover layer includes single-layer opposing side portions positioned on opposing sides of the strip arrangement outwardly of opposing outermost side edges thereof such that no portion of the strip arrangement is positioned between the side portion and the portion of the wall component to which the side portion is attached, wherein the cover layer is comprised of a tape having an adhesive on an underneath surface thereof such that adhesive on the side portions are capable of securing the fire block strip to a wall component.

12. The fire block strip of claim 11, wherein the cover layer is a polypropylene tape.

13. The fire block strip of claim 11, additionally comprising a removable protective layer that covers the underneath surface of the side portions of the cover layer, the fire-resistant material strip and the foam strip.

14. The fire block strip of claim 11, additionally comprising an adhesive layer underneath the fire-resistant material strip and the foam strip.

15. The fire block strip of claim 11, wherein a width of the fire-resistant material strip is greater than a width of the foam strip.

16. A fire block wall structure, comprising:

a wall frame comprising a plurality of studs and a wood header, wherein an upper end of each of the studs is connected to the wood header, wherein the wood header has a first surface and opposing side surfaces, each of which defines a corner with the first surface;

a fire block strip applied lengthwise along the wood header and at least partially on the first surface, the fire block strip extending only partially across the first surface such that the fire block strip is positioned along no more than one of the corners of the wood header, the fire block strip, comprising:

a fire-resistant material strip having a rectangular cross-section and comprised of a material that expands in response to sufficient heat to create a fire-resistant barrier;

a cover layer that covers the fire-resistant material strip and includes single-layer opposing side portions positioned on opposing sides of the fire-resistant material strip outwardly of opposing outermost side edges of the fire-resistant material strip, wherein the cover layer is comprised of a tape having an adhesive on an underneath surface thereof such that adhesive on the side portions secure the fire block strip to the wood header;

a wallboard member attached to the studs and contacting the fire block strip.

17. The fire block wall structure of claim 16, wherein the fire block strip additionally comprises a foam strip comprised of a foam material and placed side-by-side with the fire-resistant material strip, wherein the cover layer covers the foam strip and side portions of the cover layer are positioned on opposing sides of the combination of the fire-resistant material strip and the foam strip.

18. The fire block wall structure of claim 17, wherein the fire block strip is applied to a corner of the wood header and a juncture between the fire-resistant material strip and the foam strip is aligned with the corner.

19. The fire block wall structure of claim 18, wherein the foam strip is positioned on an upper surface of the wood header and the fire-resistant material strip is positioned on a side surface of the wood header.

20. A multi-story wall assembly comprising a lower floor level and an upper floor level, the lower floor level comprising a lower wall portion having a header track and a plurality of studs coupled to the header track, the upper floor level comprising an upper wall portion having a footer track and a plurality of studs coupled to the footer track, the multi-story wall assembly further comprising a horizontal support structure between the lower and upper wall portions, wherein the horizontal support structure defines a floor surface of the upper floor level and a ceiling surface of the lower floor level, wherein the lower and upper wall portions comprise a lower and upper wallboard member coupled to the plurality of studs of the lower and upper wall portions, respectively, and wherein the header track and the plurality of studs of the lower floor level are movable relative to one another such that a linear deflection gap is defined between a bottom edge of the lower wallboard member and a top edge of the upper wallboard member, which permits relative movement between the lower and upper wallboard members, wherein a fire block strip is positioned in a lengthwise direction over the deflection gap and comprises an intumescent strip extending across the deflection gap and a cover layer attached to each of the lower and upper wallboard members.

* * * * *